US009692116B2

(12) United States Patent
Hui et al.

(10) Patent No.: US 9,692,116 B2
(45) Date of Patent: Jun. 27, 2017

(54) ANTENNA ARRANGEMENT, A METHOD FOR MANUFACTURING AN ANTENNA ARRANGEMENT AND A PRINTED WIRING BOARD FOR USE IN AN ANTENNA ARRANGEMENT

(75) Inventors: Ping Hui, Richmond (CA); Jari Kristian Van Wonterghem, Ottawa (CA); Chris Hynes, Burnaby (CA)

(73) Assignee: Nokia Technologies Oy, Espoo (FI)

( * ) Notice: Subject to any disclaimer, the term of this patent is extended or adjusted under 35 U.S.C. 154(b) by 896 days.

(21) Appl. No.: 12/678,332

(22) PCT Filed: Sep. 19, 2008

(86) PCT No.: PCT/EP2008/062582

§ 371 (c)(1),
(2), (4) Date: May 4, 2010

(87) PCT Pub. No.: WO2009/037353

PCT Pub. Date: Mar. 26, 2009

(65) Prior Publication Data

US 2010/0214175 A1 Aug. 26, 2010

(30) Foreign Application Priority Data

Sep. 20, 2007 (WO) ..... PCT/IB2007/003652

(51) Int. Cl.

| | |
|---|---|
| ***H01Q 1/52*** | (2006.01) |
| ***H01Q 1/48*** | (2006.01) |
| ***H01Q 1/24*** | (2006.01) |
| ***H01Q 9/04*** | (2006.01) |
| ***H01Q 5/385*** | (2015.01) |

(52) U.S. Cl.

CPC ..... *H01Q 1/48* (2013.01); *H01Q 1/243* (2013.01); *H01Q 1/521* (2013.01); *H01Q 1/523* (2013.01); *H01Q 1/525* (2013.01); *H01Q 5/385* (2015.01); *H01Q 9/0442* (2013.01); *Y10T 29/49016* (2015.01)

(58) Field of Classification Search

CPC ..... H01Q 1/243; H01Q 1/52; H01Q 1/521; H01Q 1/523; H01Q 1/525

USPC ..... 343/702, 841, 846

See application file for complete search history.

(56) References Cited

U.S. PATENT DOCUMENTS

| | | | | |
|---|---|---|---|---|
| 4,608,572 | A * | 8/1986 | Blakney et al. | 343/792.5 |
| 5,262,792 | A | 11/1993 | Egashire | 343/702 |
| 6,225,958 | B1 | 5/2001 | Amano et al. | 343/767 |
| 6,624,789 | B1 | 9/2003 | Kangasvieri et al. | 343/702 |
| 6,917,344 | B2 * | 7/2005 | Zimmerman et al. | 343/841 |
| 7,629,930 | B2 * | 12/2009 | Murch et al. | 343/700 MS |
| 2004/0125029 | A1 | 7/2004 | Maoz et al. | 343/702 |

(Continued)

FOREIGN PATENT DOCUMENTS

| | | |
|---|---|---|
| EP | 1 052 723 A2 | 11/2000 |
| EP | 1 052 723 A3 | 11/2000 |

(Continued)

*Primary Examiner* — Hoang Nguyen

(74) *Attorney, Agent, or Firm* — Harrington & Smith

(57) ABSTRACT

An antenna arrangement including: a conductive ground element having a first end and a second end; an antenna element at a first end; a first conductive part extending from the conductive ground element and a second conductive part extending from conductive ground element and separated from the first conductive part by a gap.

20 Claims, 4 Drawing Sheets

(56) References Cited

U.S. PATENT DOCUMENTS

| | | | | |
|---|---|---|---|---|
| 2005/0104783 | A1 | 5/2005 | Kojima | 343/702 |
| 2005/0159195 | A1 | 7/2005 | Huber et al. | 455/575.5 |
| 2006/0044195 | A1 | 3/2006 | Arkko et al. | 343/702 |
| 2006/0181468 | A1 | 8/2006 | Iguchi et al. | 343/702 |

FOREIGN PATENT DOCUMENTS

| | | | |
|---|---|---|---|
| GB | 2 427 311 | A | 12/2006 |
| WO | WO 03/023900 | A1 | 3/2003 |
| WO | WO 2006/070017 | A1 | 7/2006 |
| WO | WO 2007/039071 | A2 | 4/2007 |
| WO | WO 2007/039071 | A3 | 4/2007 |
| WO | WO 2007/095371 | A | 8/2007 |

* cited by examiner

ANTENNA ARRANGEMENT, A METHOD FOR MANUFACTURING AN ANTENNA ARRANGEMENT AND A PRINTED WIRING BOARD FOR USE IN AN ANTENNA ARRANGEMENT

FIELD OF THE INVENTION

Embodiments of the present invention relate to an antenna arrangement, a method for manufacturing an antenna arrangement and a printed wiring board for use in an antenna arrangement.

BACKGROUND TO THE INVENTION

Radio communication is now commonly employed in many electronic apparatus such as wireless local area network nodes, Bluetooth network nodes, cellular network nodes, radio frequency identification devices etc.

There are often constraints imposed upon the design of such apparatus such as size constraints e.g. the size of a printed wiring board (PWB) or functionality constraints e.g. the radio frequency band (or bands) at which the device should operate.

It can be difficult to tune the performance of a radio communication device while respecting imposed constraints.

BRIEF DESCRIPTION OF VARIOUS EMBODIMENTS OF THE INVENTION

According to various embodiments of the invention there is provided an antenna arrangement comprising: a conductive ground element having a first end and a second end; an antenna element at a first end; a first conductive part extending from the second end of the conductive ground element and a second conductive part extending from the second end of the conductive ground element and separated from the first conductive part by a gap.

At least a portion of the first part and a portion of the second part are separated by the gap. In some embodiments, another part of the first part and another part of the second part may meet to form a 'closed' loop. Alternatively, in some embodiments, the first part and the second part do not meet and they form an 'open' loop. The open loop may be asymmetric. It may support a closed loop electric current where a displacement current bridges the gap. It may support an additional resonance that overlaps an existing resonance associated with the conductive ground element to provide an increased bandwidth and/or better efficiency.

According to various embodiments of the invention there is provided an antenna arrangement comprising: an antenna element associated with a conductive ground element; and opposite the antenna element, a first conductive part extending away from the conductive ground element and a second conductive part extending away from the conductive ground element parallel to the first conductive ground element and separated therefrom by a gap.

According to various embodiments of the invention there is provided a method of manufacturing a multi band antenna arrangement comprising: obtaining a conductive ground element having a first end and an opposing second end and comprising an extension element, at the second end, separated from the conductive ground element by a gap; and locating a directly fed antenna element at the first end of a conductive ground element.

According to various embodiments of the invention there is provided a printed wiring board component comprising: a conductive ground element having a first end for association with an antenna element and a second end; a first conductive part extending from the second end of the conductive ground element; and a second conductive part extending from the second end of the conductive ground element and separated from the first conductive part by a gap.

In various embodiments of the invention, a desired multi band performance can be achieved using the configuration of the first part, the second part and the gap.

In various embodiments of the invention, a desired performance can be achieved while respecting an imposed constraint such as a maximum or minimum size for the conductive ground element.

According to various embodiments of the invention there is provided an antenna arrangement comprising: a conductive ground element; a first antenna element operable at least at a first frequency; a second antenna element operable at least at the first frequency; a first conductive part extending the conductive ground element; and a second conductive part extending the conductive ground element and separated from the first conductive part by a gap, wherein the first conductive part, the second conductive part and the gap are configured to provide isolation between the first antenna element and the second antenna element at least at the first frequency.

According to various embodiments of the invention there is provided a printed wiring board component comprising: a conductive ground element having a first portion for association with; a first antenna element operable at least at a first frequency and a second portion for association with a second antenna element operable at least at the first frequency; and a first conductive part extending the conductive ground element and a second conductive part extending the conductive ground element and separated from the first conductive part by a gap, wherein the first conductive part, the second conductive part and the gap are configured to provide isolation between the first antenna element and the second antenna element at least at the first frequency.

According to various embodiments of the invention there is provided a method comprising the assembly of an antenna arrangement comprising: a conductive ground element; a first antenna element operable at least at a first frequency; a second antenna element operable at least at the first frequency; a first conductive part extending the conductive ground element; and a second conductive part extending the conductive ground element and separated from the first conductive part by a gap, wherein the first conductive part, the second conductive part and the gap are configured to provide isolation between the first antenna element and the second antenna element at least at the first frequency.

In various embodiments of the invention there is provided a method comprising the assembly of the antenna arrangement, which may include the configuration of the dimensions, positions, shape and/or relative mutual proximity of the first and second conductive parts.

BRIEF DESCRIPTION OF THE DRAWINGS

For a better understanding of various embodiments of the present invention reference will now be made by way of example only to the accompanying drawings in which.

DETAILED DESCRIPTION OF VARIOUS EMBODIMENTS OF THE INVENTION

Figure 1:
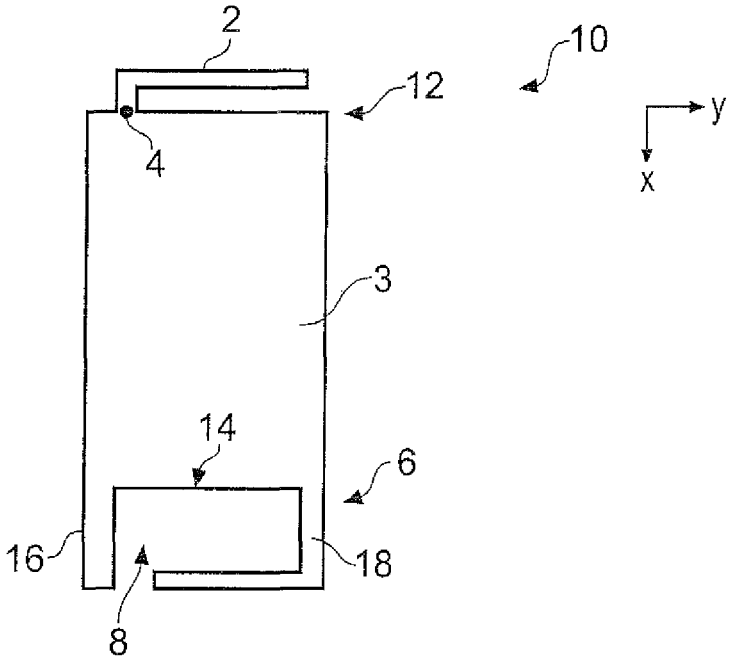
FIG. 1 schematically illustrates an antenna arrangement.

FIG. 1 schematically illustrates an antenna arrangement 10 comprising:

an antenna element 2 associated with a conductive ground element 3;

a first conductive part 16 extending away from the conductive ground element 3 and a second conductive part 18 extending away from the conductive ground element 3 and separated from the first conductive part 16 by a gap 8.

The conductive ground element 3 has a first end 12 and a second end 14 opposite the first end. The antenna element 2 is positioned at or near the first end 12.

The antenna element 2 is an electrically conductive monopole element that is directly fed via feed 4 at one of its ends. The other end is free-standing. There is typically a matching network connected to the feed on the ground element 3. In the embodiment illustrated, the antenna element 2 is a planer inverted L antenna (PILA) positioned adjacent the edge of the first end 12 of the conductive ground element 3. The PILA has as it lowest resonant mode a $\lambda/4$ mode i.e. at resonance the electrical length of the antenna element equals $\lambda/4$, where $\lambda$ is the wavelength at resonance. Although a particular type of antenna element 2 has been illustrated, it should be appreciated that other types of antenna elements may be used such as e.g. a planar inverted F antenna (PIFA), a patch antenna, a wire antenna (monopole, dipole, helix, etc), and other known antenna elements as used in the art.

The conductive ground element 3 provides a ground potential reference. It operates as a ground plane for the antenna element 2.

The conductive ground element 3 comprises a significant surface area of continuous solid conductor between the first end 12 and the second end 14.

This area may, for example, be used as a printed wiring board (PWB) for carrying electronic components and may be of substantially rectangular shape. The conductive ground element 3 may be on one of more layers of the printed wiring board (PWB), in a multi-layer printed wiring board.

The conductive ground element 3 may be formed from metallic or conductive objects present in a typical portable electronic device, e.g. battery, shields, internal or external covers, frames, and other electronic or mechanical parts, whilst not being limited to this list of parts. These parts may or may not be electrically connected to the printed wiring board.

The first conductive part 16 and the second conductive part 18 are both situated at an extremity 6 of the conductive ground element 3 that includes the second end 14 of the conductive ground element 3 and is opposite the first end 12 of the conductive ground element 3. The first conductive part 16 and the second conductive part 18 may be elements that are integral portions of the conductive ground element 3 or may be additional elements that are galvanically connected to the conductive ground element 3.

Figure 3:
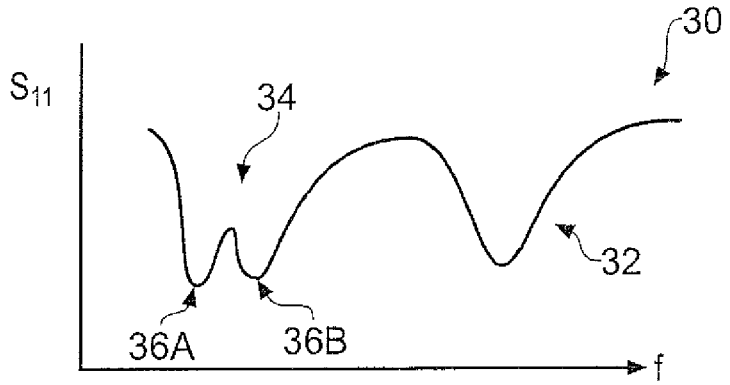
FIG. 3 illustrates an example of a plot of return loss (S11) against operating frequency for an antenna arrangement.

The antenna arrangement 10 may be single band or multi-band. FIG. 3 illustrates a trace 30 of return loss (S11) against operating frequency for a multi band arrangement 10. In this example, the antenna arrangement 10 has a high band resonance 32 provided by the directly fed resonant antenna element 2 and a broad low band resonance 34 provided by the adjacent low band resonances 36A and 36B. The low band resonance 36B is an additional mode provided by the parts 16, 18 at the extremity 6 of the conductive ground element 3 which by virtue of strong coupling between the parts 16, 18, extend the conductive ground element 3. The low band resonance 36A is excited by the antenna element 2 and the conductive ground element 3.

The electrical length of the conductive ground element 3 may, in some embodiments, be used to tune the high band resonance 32 which is dependent upon resonant modes excited in the conductive ground element 3 by the antenna element 2 and also tune the low band resonance 36A which is typically a harmonic of the high band resonant frequency. For example, in the example illustrated in FIG. 1, increasing the physical length of the conductive ground element 3 in the +x direction may lower the resonant frequency of the high band resonance 32 and also lower the resonant frequency of the low band resonance 36A.

The configuration and electrical lengths of the first part 16 and second part 18 may, in some embodiments, be used to tune the low band resonance 34.

The conductive parts 16, 18 operate as extensions to the conductive ground element 3. The FIGS. 1 and 2A-2E illustrate various different configurations for the first and second conductive parts 16 and 18 and the intervening gap 8.

It has been observed that extending the electrical length of the conductive element 3 using the first conductive part 16 and the second conductive part 18 increases the low band resonance bandwidth 34.

Figure 2A:
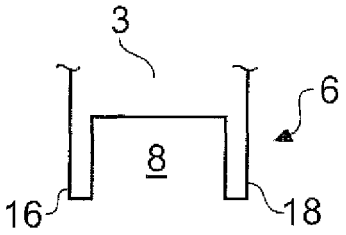
FIGS. 2A to 2E schematically illustrate alternative antenna arrangements.
Figure 2B:
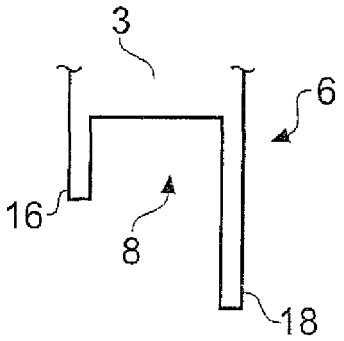
Figure 2C:
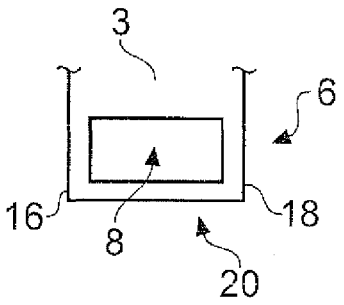

It has been observed that the increase in bandwidth can be greater for those arrangements that are asymmetric (FIGS. 1, 2B, 2D, 2E etc) compared to those that are symmetric (FIGS. 2A, 2C). The asymmetry typically arises because the physical length of one of the first and second parts 16, 18 is greater than the physical length of the other of the first and second parts 16, 18.

It has been observed that some configurations of the first and second parts (e.g. FIGS. 1, 2D, 2E) create a strong additional resonance 36B adjacent and overlapping a low band resonance 36A associated with the conductive ground element 3 and thereby increase the bandwidth of the low band resonance 34. It is believed that the strong additional resonance arises from a closed electric current loop existing in the open loop structure formed by the gap 8 and the first and second parts 16, 18. The electric current loop is closed, across the gap 8 of the open loop structure, by a displacement current. A strong additional resonance arises when there is amplitude and phase matching of the displacement current across the gap 8. For this to occur, the gap should be narrow, e.g. less than 1/10th the size of the resonant wavelength.

The arrangement of the first conductive part 16, the second conductive part 18 and the gap 8 may be chosen so that the additional resonance created by the closed electric current loop has a resonant frequency 36B adjacent the existing resonant frequency 36A of the antenna arrangement 10 thereby increasing the bandwidth. Although, the first conductive part 16 and the second conductive part 18 have been described as modifying the low frequency band, it should be appreciated that by varying the parts and, in particular their electrical lengths, they could alternatively be used to modify the high frequency band 32.

FIG. 2A illustrates the extremity 6 of the conductive ground element 3 in one embodiment of the antenna arrangement 10. In this symmetric embodiment, the first part 16 and the second part 18 are unconnected and form an 'open' loop with a large gap 8. They extend parallel to each other away from the edge defined by the second end 14 and have the same physical length. In this example, they extend in the same plane as that occupied by the conductive ground element 3 and there is a large gap between them.

FIG. 2B illustrates the extremity 6 of the conductive ground element 3 in another embodiment of the antenna arrangement 10. In this asymmetric embodiment, the first part 16 and the second part 18 are unconnected and form an 'open' loop with a large gap 8. They extend parallel to each other away from the edge defined by the second end 14. However, the second part 18 is longer than the first part 16. In this example, they extend in the same plane as that occupied by the conductive ground element 3. In this embodiment, the gap 8 is too large for the creation of a current loop and an associated strong additional resonant mode 36B.

FIG. 2C illustrates the extremity 6 of the conductive ground element 3 in another embodiment of the antenna arrangement 10. In this symmetric embodiment, the first part 16 and the second part 18 are connected and form a 'closed' loop. They extend away from the edge defined by the second end 14 and then bend to meet each other and close the loop. In this particular example, the first part 18 and the second part 18 extend parallel to each other in the +x direction perpendicular to the edge defined by the second end 14 for the same distance and then bend at right angles to extend in the y direction and meet. In this example, the first part 16 and the second part 18 extend in the same plane as that occupied by the conductive ground element 3. In this embodiment, the boundary conditions are such that a current loop and an associated additional resonant mode 36B are not created.

The performance properties of the low band resonance 34 may also be tuned by adjusting the size and shape of the gap 8 defined between the conductive ground element 3, the first part 16 and the second part 18. Reducing the size of the gap encourages a displacement current between the first and second parts which forms a closed electric current loop and an associated additional resonant mode 36B.

Figure 2D:
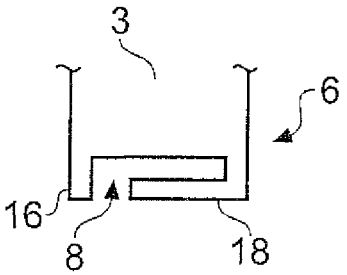

FIG. 2D illustrates the extremity 6 of the conductive ground element 3 in another embodiment of the antenna arrangement 10. In this asymmetric embodiment, the first part 16 and the second part 18 are unconnected and form an 'open' loop with a small gap at their extremities. They initially extend parallel to each other away from the edge defined by the second end 14, then the second part 18, which is longer than the first part 16, bends at right angles and extends towards the first part 16. In this example, they extend in the same plane as that occupied by the conductive ground element 3. The gap 8 resembles a slot in that it has a length that is much greater than its width. The length of the slotted gap 8 is approximately the same as the length of the second part 18 and the width of the slotted gap 8 and the width of the first and second parts are of approximately the same size.

In comparison, the gaps 8 illustrated in FIGS. 2A-2C have a much greater area.

Figure 2E:
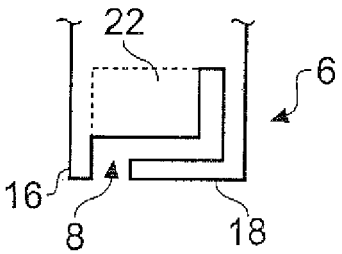

FIG. 2E illustrates a variation to the asymmetric embodiment illustrated in FIG. 2D. In this embodiment, the slot 8 bends into the conductive ground element 3 and extends in the −x direction. This further increases the length of the second part 18. In this example, the locations where the first part 16 and the second part 18 initially extend from the conductive ground element 3 are displaced in the x direction. A potential cut-away portion 22 is labeled, which, if removed would result in the embodiment illustrated in FIG. 2E resembling that illustrated in FIG. 1.

Figure 7:
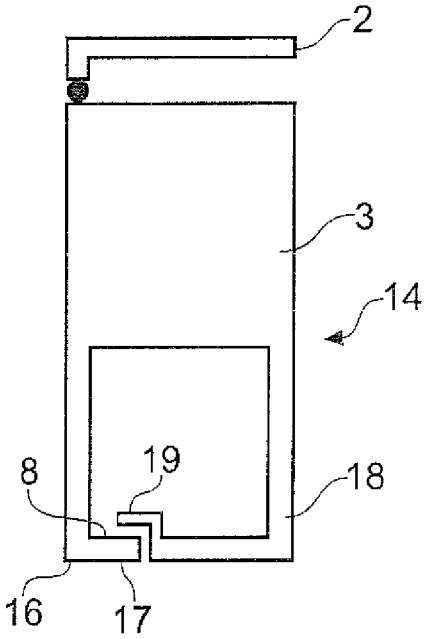
FIG. 7 schematically illustrates another antenna arrangement in which extremities of the first conductive part and the second conductive part run parallel to each other.

FIG. 7 schematically illustrates another asymmetric embodiment. The first conductive part 16 and the second conductive part 18 are unconnected and form an 'open' loop with a small gap 8 between their extremities 17, 19. The extremities 17, 19 run parallel to each other separated by the small gap 8. The parts 16, 18 initially extend parallel to each other away from the edge defined by the second end 14. Then the parts bend at right angles and extend towards each other. The second part 18, which is longer than the first part 16, bends at right angles twice in quick succession as it approaches the first part 16. This forms a kink in the second part 18 which places its extremity 18 parallel with the extremity 17 of the first conductive part 16.

Figure 6:
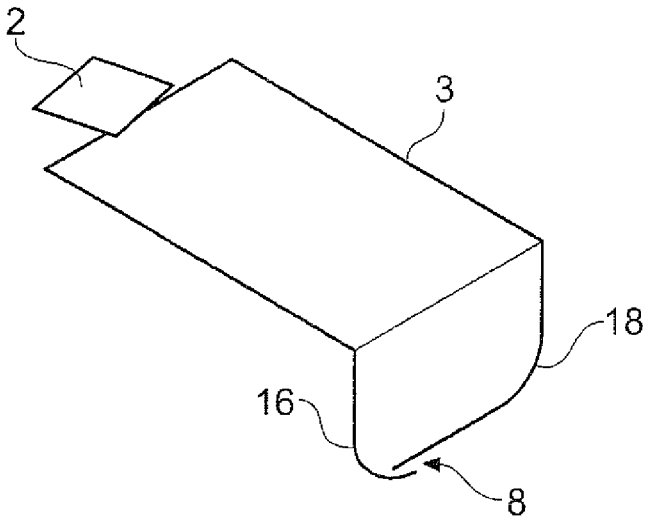
FIG. 6 schematically illustrates an antenna arrangement that is arranged to conform with a user's body.

In the example illustrated in FIG. 1, the conductive ground element 3 is a flat solid planar structure, however, in other embodiments it may be three dimensional. It may, for example, be bent or curved in a third dimension to conform with a user's body as illustrated in FIG. 6. In this Fig, the conductive ground element 3 is curved so that it conforms to a user's body such as, for example, their arm or leg. The first conductive part 16 and the second conductive part 18 extend away from the conductive ground element 3 in a direction substantially perpendicular to a mid plane of the conductive ground element 3. The first conductive part 16 and the second conductive part 18 form an open loop structure that may, for example, receive part of a user's limb such as their wrist or ankle. In other similar embodiments, the conductive ground element 3 may be formed from more than one sub-part and which are coupled together to form the overall conductive ground element 3. These may form a substantially three dimensional shape as part of a complex portable device design. The first conductive part 16 and the second conductive part 18 may also be formed in three dimensions, and may not necessarily be formed in a single plane. For example, if there are other components or modules within the total portable device, the additional conductive parts (16, 18) may need to be wrapped around other components, for example, a connector or a memory card slot, etc.

Figure 4:
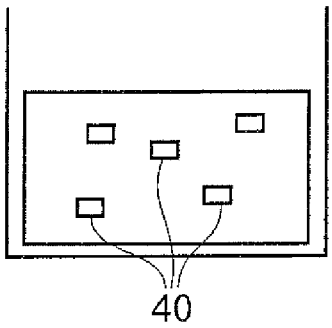
FIG. 4 illustrates an embodiment in which components are placed in a gap defined in a ground plane of the antenna arrangement.

If a large area gap 8 is used, as illustrated in FIGS. 1 and 2A to 2C then additional components 40 may be placed in the gap 8 as illustrated in FIG. 4 without significantly impairing the performance of the antenna arrangement 10. The additional components may be electrical circuits and antennas that may be unconnected to the first and second parts 16, 18. For example, the additional components may include a near field coil and reader.

The first conductive part 16 and the second conductive part 18 form an antenna-like structure. It may, in some embodiments, be possible to use a complimentary form of antenna structure which replaces gap with conductor and conductor with gap. This will reverse the Electric and Magnetic fields and may enable polarization diversity.

Figure 8:
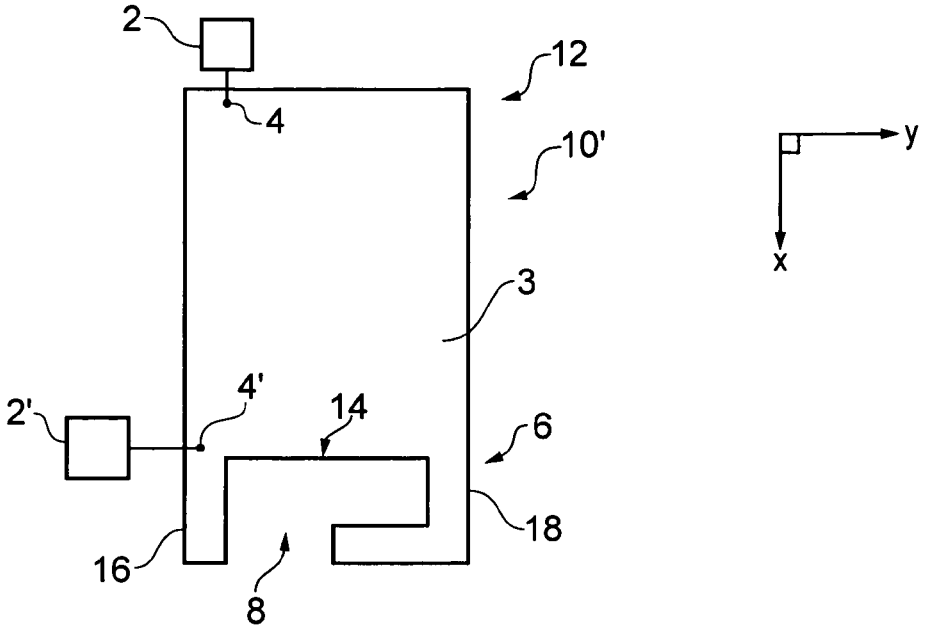
FIG. 8 schematically illustrates an antenna arrangement.

FIG. 8 schematically illustrates an antenna arrangement 10' similar to that illustrated in FIG. 1 and similar features are designated using the same or similar reference numerals. Thus the antenna arrangement 10' illustrated in FIG. 8 also comprises a first antenna element 2 associated with a conductive ground element 3; a first conductive part 16 extending away from the conductive ground element 3 and a second conductive part 18 extending away from the conductive ground element 3 and separated from the first conductive part 16 by a gap 8. The antenna arrangement 10' illustrated in FIG. 8 also, additionally, comprises a second antenna element 2'.

The conductive ground element 3 has a first end 12 and a second end 14 opposite the first end. In the illustrated example, the first antenna element 2 is positioned at or near the first end 12 and the second antenna element 2' is positioned at or near the second end 14 close to the second conductive part.

In this example, the first antenna element 2 is an electrically conductive monopole element that is directly fed via feed 4 at one of its ends. The other end is free-standing. There is typically a matching network connected to the feed on the ground element 3. The first antenna element 2 may be a planar inverted F antenna (PIFA) as illustrated in FIG. 1, a patch antenna, a wire antenna (monopole, dipole, helix, etc), or another antenna element as used in the art.

In this example, the second antenna element 2' is also an electrically conductive monopole element that is directly fed via feed 4' at one of its ends. The other end is free-standing. There is typically a matching network connected to the feed on the ground element 3. The antenna element 2' may be a planar inverted F antenna (PIFA) as illustrated in FIG. 1, a patch antenna, a wire antenna (monopole, dipole, helix, etc), or another antenna element as used in the art.

The conductive ground element 3 provides a ground potential reference. It operates as a ground plane for the first antenna element 2 and the second antenna element 2'.

The conductive ground element 3 may comprise a significant surface area of continuous solid conductor between the first end 12 and the second end 14.

This area may, for example, be used as a printed wiring board (PWB) for carrying electronic components and may be of substantially rectangular shape. The conductive ground element 3 may be on one or more layers of the printed wiring board (PWB), in a multi-layer printed wiring board.

The conductive ground element 3 may be formed from metallic or conductive objects present in a typical portable electronic device, e.g. battery, shields, internal or external covers, frames, and other electronic or mechanical parts, whilst not being limited to this list of parts. These parts may or may not be electrically connected to the printed wiring board.

Figure 9A:
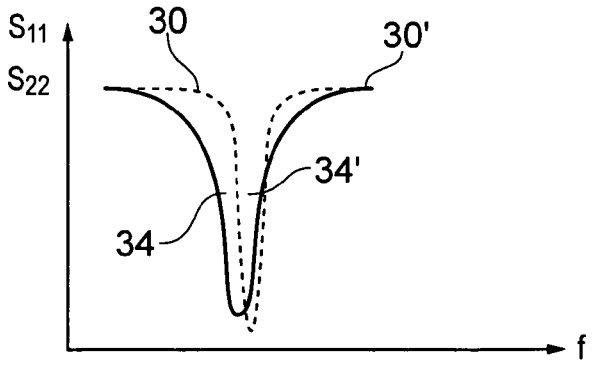
FIGS. 9A to 9B illustrate an example of a plot of return loss (S11) and (S22) against operating frequency for an antenna arrangement.

The first conductive part 16 and the second conductive part 18 are both situated, in this example, at an extremity 6 of the conductive ground element 3 that includes the second end 14 of the conductive ground element 3 and is opposite the first end 12 of the conductive ground element 3. The first conductive part 16 and the second conductive part 18 may be elements that are integral portions of the conductive ground element 3 or may be additional elements that are galvanically connected to the conductive ground element 3. FIG. 9A illustrates a trace 30 of return loss (S11) against operating frequency for the first antenna element 2 and also a trace 30' of return loss (S22) against operating frequency for the second antenna element 2'. In this example, the first antenna element 2 has a low band resonance 34 and the second antenna element 2' has a low band resonance 34'.

The electrical length of the conductive ground element 3 may, in some embodiments, be used to tune the low band resonances 34, 34'. In the example illustrated in FIG. 8, increasing the physical length of the conductive ground element 3 in the −x direction may lower the resonant frequency of one or more of the low band resonances 34, 34'.

Figure 9B:
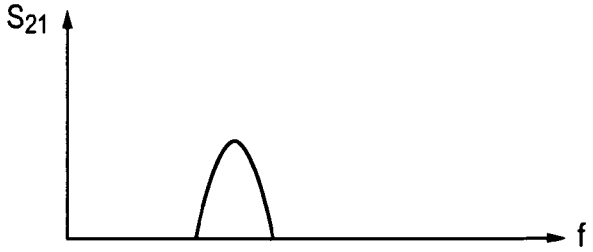

The configuration and electrical lengths of the first part 16 and second part 18 may, in some embodiments, be used to tune the isolation between the first antenna element 2 and the second antenna element 2'. The isolation (S21) is illustrated in FIG. 9B.

The conductive parts 16, 18 operate as extensions to the conductive ground element 3 (ground element extensions)

Modes occurring in the conductive ground element 3 naturally, are enhanced by placing the extending conductive parts 16, 18 where most of the current tends to flow in the conductive ground element 3 (along the edge) and then bringing the extending conductive parts 16, 18 into proximity.

As an example, the conductive part 16 may, in combination with the conductive ground element 3, form a first resonant mode, and the conductive part 18 may in combination with the conductive ground element 3, form a second resonant mode. The proximal placement of both conductive parts 16 and 18 couples the two distinct modes. The FIGS. 8 and 2A-2E illustrate various different configurations for the first and second conductive parts 16 and 18 and the intervening gap 8.

Without the gap 8 and therefore without the conductive parts 16 and 18, both the first antenna 2 and the second antenna 2' share the same chassis mode or conductive ground element resonance, resulting in a high level of antenna coupling between the first antenna 2 and the second antenna 2'.

With the introduction of the gap 8 formed by adding the conductive parts 16 and 18, two discrete chassis modes are created, each chassis mode having it's own resonant frequency. The first antenna 2 is tuned to the first chassis mode, and the second antenna 2' is tuned to the second chassis mode. Since the two chassis modes have different current distributions, the isolation between the first antenna 2 and second antenna 2' are improved.

It has been observed for some configurations of the first and second parts (e.g. FIGS. 1, 2D, 2E) that the combination of the conductive ground element 3 and the first part 16 creates a strong resonance overlapping the low band resonances 34 and the combination of the conductive ground element 3 and the second part 18 creates a strong resonance overlapping the low band resonance 34'.

It may be desirable to keep the gap 8 sufficiently wide to prevent too strong coupling between the first conductive part 16 and the second conductive part 18 which would reduce the isolation between the antenna 2 and the second antenna 2'. A sufficiently wide gap may be greater than 1/10th the size of the resonant wavelength.

In the example of FIG. 8, coupling between the first and second conductive parts 16, 18 may be controlled by varying the length, position and/or orientation of the first and second conductive parts 16, 18.

In the example of FIG. 8, the position of the first and second antennas 2, 2' may affect the coupling between the first and second conductive parts 16, 18.

The antenna 2 and the second antenna 2' may be, for example, a main antenna and diversity antenna operating in the same or overlapping frequency ranges. The antenna 2 and the second antenna 2' may be, for example, multiple input and/or multiple output antennas (e.g. MIMO) operating in the same or overlapping frequency ranges.

The antenna 2 and the second antenna 2' share the dominant radiator the extended conductive ground element 3. The first part 16 and second part 18 extend and adapt the conductive ground element 3. They create additional resonances or 'chassis modes' which improve the isolation between the antenna 2 and the second antenna 2'.

Figure 5:
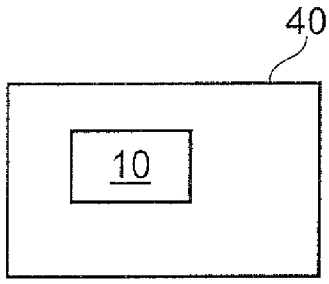
FIG. 5 schematically illustrates an apparatus comprising an antenna arrangement.

FIG. 5 schematically illustrates an apparatus 40 comprising the antenna arrangement 10. The apparatus 40 may use the conductive ground element 3 as a printed wiring board (PWB). It may also have electrical components positioned within the gap 8 of the antenna arrangement 10.

The apparatus 10 may be any type of apparatus that transmits and/or receives radio waves.

It may, for example, operate in any one or more of the following frequency bands: AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz).

The antenna arrangement 10 may, for example, be manufactured by obtaining a conductive ground element having a first end and an opposing second end and comprising an extension element, at the second end, separated from the conductive ground element by a gap; and locating a directly fed antenna element at the first end of a conductive ground element. The required conductive ground element may be provided as a printed wiring board component.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An antenna arrangement comprising:

a conductive ground element having a first end and a second and opposite the first end;

a first antenna element positioned at the first end and configured to operate at least at a first frequency;

a second antenna element positioned at the second end and configured to operate at least at the first frequency;

a first conductive part positioned at the second end of the conductive ground element and extending the conductive ground element; and a second conductive part positioned at the second end of the conductive ground element and extending the conductive ground element and separated from the first conductive part by a gap, wherein the first conductive part, the second conductive part and the gap are configured to provide isolation between the first antenna element and the second antenna element at least at the first frequency, and wherein the first conductive part and the second conductive part extend from an edge at the second end of the conductive ground element, separated by said gap, and the second conductive part extends in a first direction from the edge to a bend and extends in a second direction from the bend towards the first conductive part.

2. An antenna arrangement as claimed in claim 1, wherein the first conductive part is sized to couple with the second conductive part.

3. An antenna arrangement as claimed in claim 1, wherein the first conductive part and the second conductive part have different lengths and are asymmetrically arranged.

4. An antenna arrangement as claimed in claim 1, wherein the first conductive part and the second conductive part are dimensioned and arranged to introduce a first and second resonant modes.

5. An antenna arrangement as claimed in claim 4, wherein the first resonant mode and the second resonant mode are tunable by dimensions of the first and/or second conductive parts.

6. An antenna arrangement as claimed in claim 1, wherein the gap between an extremity of the first conductive part and an extremity of the second conductive part, which is nearest the extremity of the first conductive part, is greater than $1/10^{th}$ the size of a wavelength associated with the first resonant frequency.

7. An antenna arrangement as claimed in claim 1, wherein the conductive ground element comprises a significant area of continuous conductor between the first and second end.

8. An antenna arrangement as claimed in claim 1, wherein the antenna arrangement is configured to operate in a lower frequency band and a higher frequency band, the conductive ground element having a dimension that is configured to tune a high band resonance and the first and second conductive parts having dimensions configured to tune a low band resonance.

9. An antenna arrangement as claimed in claim 8, wherein the gap is configured to tune the low band resonance.

10. An antenna arrangement as claimed in claim 1, wherein the first conductive part and the second conductive parts join to form a closed loop.

11. A portable electronic device comprising the antenna arrangement as claimed in claim 1.

12. An antenna arrangement as claimed in claim 1, wherein the first end of the conductive ground element has a first edge and the second end of the conductive ground element has a second edge, opposite to the first edge, the first conductive part extending from the second edge of the conductive ground element, and the second conductive part extending from the second edge of the conductive ground element.

13. A printed wiring board component comprising:

a conductive ground element having a first end and a second end opposite the first end;

a first antenna element positioned at the first end and configured to operate at least at a first frequency;

a second antenna element positioned at the second end and configured to operate at least at the first frequency; and a first conductive part positioned at the second end of the conductive ground element and extending the conductive ground element; and a second conductive part positioned at the second end of the conductive ground element and extending the conductive ground element and separated from the first conductive part by a gap, wherein the first conductive part, the second conductive part and the gap are configured to provide isolation between the first antenna element and the second antenna element at least at the first frequency, and wherein the first conductive part and the second conductive part extend from an edge at the second end of the conductive ground element, separated by said gap, and the second conductive part extends in a first direction from the edge to a bend and extends in a second direction from the bend towards the first conductive part.

14. An antenna arrangement as claimed in claim 1, wherein the second antenna element is fed via a feed on the conductive ground element.

15. An antenna arrangement as claimed in claim 1, wherein the gap is defined by the second end of the conductive ground element, the first conductive part and the second conductive part.

16. An antenna arrangement as claimed in claim 1, wherein the first conductive part in combination with the conductive ground element is configured to form a first resonant mode, and the second conductive part in combination with the conductive ground element is configured to form a second resonant mode.

17. A printed wiring board component as claimed in claim 13, wherein the conductive ground element comprises a significant surface area of continuous solid conductor between the first and second ends.

18. A method comprising the assembly of an antenna arrangement comprising:

a conductive ground element having a first end and a second end opposite the first end;

a first antenna element positioned at the first end and configured to operate at least at a first frequency;

a second antenna element positioned at the second end and configured to operate at least at the first frequency;

a first conductive part positioned at the second end of the conductive ground element and extending the conductive ground element; and a second conductive part positioned at the second end of the conductive ground element and extending the conductive ground element and separated from the first conductive part by a gap, wherein the first conductive part, the second conductive part and the gap are configured to provide isolation between the first antenna element and the second antenna element at least at the first frequency, and wherein the first conductive part and the second conductive part extend from an edge at the second end of the conductive ground element, separated by said gap, and the second conductive part extends in a first direction from the edge to a bend and extends in a second direction from the bend towards the first conductive part.

19. A method as claimed in claim 18, further comprising configuring the first conductive part and the second conductive part to be dimensioned and arranged to introduce at least one resonance.

20. A method as claimed in claim 18, further comprising assembling the first conductive part and the second conductive part such that the gap between an extremity of the first conductive part and an extremity of the second conductive part, which is nearest the extremity of the first conductive part, is less than $1/10^{th}$ the size of a wavelength associated with a resonant frequency of the introduced resonance.

* * * * *